US011296412B1

(12) United States Patent
He et al.

(10) Patent No.: US 11,296,412 B1
(45) Date of Patent: Apr. 5, 2022

(54) 5G BROADBAND ANTENNA

(71) Applicant: Airgain Incorporated, San Diego, CA (US)

(72) Inventors: Ziming He, Irvine, CA (US); Alven Jan Delos Santos Eusantos, San Diego, CA (US)

(73) Assignee: Airgain, Inc., San Diego, CA (US)

( * ) Notice: Subject to any disclaimer, the term of this patent is extended or adjusted under 35 U.S.C. 154(b) by 217 days.

(21) Appl. No.: 16/379,767

(22) Filed: Apr. 9, 2019

Related U.S. Application Data

(63) Continuation-in-part of application No. 16/258,611, filed on Jan. 27, 2019, now Pat. No. 10,868,354.

(60) Provisional application No. 62/793,871, filed on Jan. 17, 2019.

(51) Int. Cl.

| | |
|---|---|
| ***H01Q 5/28*** | (2015.01) |
| ***H01Q 21/00*** | (2006.01) |
| ***H01Q 5/50*** | (2015.01) |
| ***H01Q 5/371*** | (2015.01) |

(52) U.S. Cl.
CPC ..... *H01Q 5/28* (2015.01); *H01Q 5/371* (2015.01); *H01Q 5/50* (2015.01); *H01Q 21/0043* (2013.01)

(58) Field of Classification Search
CPC ..... H01Q 5/371; H01Q 5/15; H01Q 5/30; H01Q 5/357; H01Q 5/364
See application file for complete search history.

(56) References Cited

U.S. PATENT DOCUMENTS

| | | | | |
|---|---|---|---|---|
| D418,142 | S | 12/1999 | Thill | |
| 6,087,990 | A | 7/2000 | Thill et al. | |
| 6,624,793 | B1 * | 9/2003 | Su | H01Q 9/28 343/793 |
| 6,850,191 | B1 | 2/2005 | Thill et al. | |
| 7,042,415 | B2 * | 5/2006 | Cheng | H01Q 9/28 343/793 |
| 7,061,437 | B2 | 6/2006 | Lin et al. | |
| 7,148,849 | B2 | 12/2006 | Lin | |
| 7,215,296 | B2 | 5/2007 | Abramov et al. | |
| D546,821 | S | 7/2007 | Oliver | |
| D549,696 | S | 8/2007 | Oshima et al. | |
| 7,333,067 | B2 | 2/2008 | Hung et al. | |
| 7,336,959 | B2 | 2/2008 | Khitrik et al. | |
| D573,589 | S | 7/2008 | Montgomery et al. | |
| 7,405,704 | B1 | 8/2008 | Lin et al. | |
| 7,477,195 | B2 | 1/2009 | Vance | |
| D592,195 | S | 5/2009 | Wu et al. | |
| 7,570,215 | B2 | 8/2009 | Abramov et al. | |
| D599,334 | S | 9/2009 | Chiang | |
| D606,053 | S | 12/2009 | Wu et al. | |
| D607,442 | S | 1/2010 | Su et al. | |
| D608,769 | S | 1/2010 | Bufe | |

(Continued)

*Primary Examiner* — Dameon E Levi
*Assistant Examiner* — Jennifer F Hu
(74) *Attorney, Agent, or Firm* — Clause Eight; Michael Catania

(57) ABSTRACT

A 5G broadband antenna is disclosed herein. The 5G broadband antenna comprises a first antenna element and a second antenna element. Each of the first antenna element and the second antenna element has a main branch with a slot therein. The antenna apparatus covers a first frequency band of 617-960 MegaHertz, a second frequency band of 1.4-1.6 GigaHertz (GHZ), a third frequency band of 1.71-2.7 GHz, a fourth frequency band of 3.3 to 4.2 GHz, and a fifth frequency band of 4.3 to 6.0 GHz.

11 Claims, 13 Drawing Sheets

(56) References Cited

U.S. PATENT DOCUMENTS

D612,368 S 3/2010 Yang et al.
7,705,783 B2 4/2010 Rao et al.
7,729,662 B2 6/2010 Abramov et al.
D621,819 S 8/2010 Tsai et al.
7,843,390 B2 11/2010 Liu
D633,483 S 3/2011 Su et al.
D635,127 S 3/2011 Tsai et al.
7,907,971 B2 3/2011 Salo et al.
D635,560 S 4/2011 Tsai et al.
D635,963 S 4/2011 Podduturi
D635,964 S 4/2011 Podduturi
D635,965 S 4/2011 Mi et al.
D636,382 S 4/2011 Podduturi
7,965,242 B2 6/2011 Abramov et al.
D649,962 S 12/2011 Tseng et al.
D651,198 S 12/2011 Mi et al.
D654,059 S 2/2012 Mi et al.
D654,060 S 2/2012 Ko et al.
D658,639 S 5/2012 Huang et al.
D659,129 S 5/2012 Mi et al.
D659,685 S 5/2012 Huang et al.
D659,688 S 5/2012 Huang et al.
8,175,036 B2 5/2012 Visuri et al.
8,184,601 B2 5/2012 Abramov et al.
D662,916 S 7/2012 Huang et al.
8,248,970 B2 8/2012 Abramov et al.
D671,097 S 11/2012 Mi et al.
8,310,402 B2 11/2012 Yang
D676,429 S 2/2013 Gosalia et al.
D678,255 S 3/2013 Ko et al.
8,400,364 B2 * 3/2013 Kotaka ..... H01Q 1/243 343/702
8,423,084 B2 4/2013 Abramov et al.
D684,565 S 6/2013 Wei
D685,352 S 7/2013 Wei
D685,772 S 7/2013 Zheng et al.
D686,600 S 7/2013 Yang
8,502,747 B2 * 8/2013 Chang ..... H01Q 5/392 343/822
D689,474 S 9/2013 Yang et al.
D692,870 S 11/2013 He
D694,738 S 12/2013 Yang
D695,279 S 12/2013 Yang et al.
D695,280 S 12/2013 Yang et al.
8,654,030 B1 2/2014 Mercer
8,669,903 B2 3/2014 Thill et al.
D703,195 S 4/2014 Zheng
D703,196 S 4/2014 Zheng
D706,247 S 6/2014 Zheng et al.
D706,750 S 6/2014 Bringuir
D706,751 S 6/2014 Chang et al.
D708,602 S 7/2014 Gosalia et al.
D709,053 S 7/2014 Chang et al.
D710,832 S 8/2014 Yang
D710,833 S 8/2014 Zheng et al.
8,854,265 B1 10/2014 Yang et al.
D716,775 S 11/2014 Bidermann
8,982,006 B2 * 3/2015 Wang ..... H01Q 5/364 343/821
9,070,966 B2 * 6/2015 Ng ..... H01Q 5/25
D735,173 S 7/2015 Gosalia et al.
D741,301 S 10/2015 He
D747,297 S 1/2016 He
D754,108 S 4/2016 Yang et al.
D763,832 S 8/2016 Gosalia
D763,834 S 8/2016 Zheng et al.
D764,446 S 8/2016 Chang et al.
D764,447 S 8/2016 Yang et al.
D765,062 S 8/2016 Zheng et al.
9,432,070 B2 8/2016 Mercer
D766,220 S 9/2016 He et al.
D766,221 S 9/2016 Zheng et al.
D766,880 S 9/2016 He et al.
D766,882 S 9/2016 Schulteis
D766,883 S 9/2016 Yang
D766,884 S 9/2016 Zheng
D767,542 S 9/2016 Chang et al.
D767,543 S 9/2016 Chang
D767,544 S 9/2016 Yang et al.
D768,116 S 10/2016 Zheng et al.
D768,117 S 10/2016 Yang
D768,118 S 10/2016 Chang et al.
D773,444 S 12/2016 He et al.
D776,643 S 1/2017 He
D778,881 S 2/2017 Zheng et al.
D778,882 S 2/2017 Zheng et al.
D778,883 S 2/2017 Zheng et al.
D779,463 S 2/2017 Zheng et al.
D779,465 S 2/2017 Bian et al.
D780,723 S 3/2017 Gosalia et al.
D780,724 S 3/2017 Chang et al.
D781,823 S 3/2017 Chang et al.
D782,448 S 3/2017 Gosalia
D782,449 S 3/2017 Bian et al.
D784,303 S 4/2017 Zheng et al.
D784,965 S 4/2017 Chang et al.
D785,604 S 5/2017 Chang et al.
D786,838 S 5/2017 Chang et al.
D786,839 S 5/2017 Zheng et al.
D786,840 S 5/2017 He et al.
D788,082 S 5/2017 Zheng et al.
D788,083 S 5/2017 Zheng et al.
D788,086 S 5/2017 He et al.
D789,912 S 6/2017 Zheng et al.
D789,914 S 6/2017 Chang et al.
D791,108 S 7/2017 He et al.
D791,745 S 7/2017 Gosalia
D792,381 S 7/2017 He et al.
D792,382 S 7/2017 Gosalia et al.
D792,870 S 7/2017 Zheng et al.
D792,871 S 7/2017 Zheng
D793,373 S 8/2017 Iellici
D793,998 S 8/2017 He et al.
D794,000 S 8/2017 Gosalia
D794,616 S 8/2017 Gosalia et al.
D795,227 S 8/2017 Chang et al.
D795,228 S 8/2017 He
D795,845 S 8/2017 Chang et al.
D795,846 S 8/2017 Chang et al.
D795,847 S 8/2017 He
D795,848 S 8/2017 Zheng et al.
D796,492 S 9/2017 He et al.
D797,708 S 9/2017 Yang
D798,276 S 9/2017 Zheng et al.
D798,277 S 9/2017 Chang et al.
D798,278 S 9/2017 Zhao et al.
D798,279 S 9/2017 Raffaelli
D798,280 S 9/2017 Zheng
D798,846 S 10/2017 Chang et al.
D799,453 S 10/2017 Chang et al.
D799,457 S 10/2017 Chang et al.
D799,458 S 10/2017 Chang et al.
D801,954 S 11/2017 He et al.
D801,955 S 11/2017 He
D801,956 S 11/2017 He
D801,957 S 11/2017 He et al.
D802,566 S 11/2017 Yang
D802,567 S 11/2017 Zheng et al.
D802,569 S 11/2017 Zheng et al.
D803,194 S 11/2017 Yang
D803,197 S 11/2017 He et al.
D803,198 S 11/2017 He et al.
D804,457 S 12/2017 Chang et al.
D804,458 S 12/2017 Chang et al.
D807,332 S 1/2018 Chang et al.
D807,333 S 1/2018 He et al.
D807,334 S 1/2018 Iellici et al.
D807,864 S 1/2018 He et al.
D807,865 S 1/2018 He et al.
D810,056 S 2/2018 Chang et al.
D810,058 S 2/2018 Zheng et al.
D812,044 S 3/2018 Iellici
D812,596 S 3/2018 Iellici
D813,851 S 3/2018 Chang et al.

(56) References Cited

U.S. PATENT DOCUMENTS

| | | | |
|---|---|---|---|
| 9,912,043 | B1 | 3/2018 | Yang |
| D814,448 | S | 4/2018 | Montgomery |
| D815,072 | S | 4/2018 | Chang et al. |
| D816,643 | S | 5/2018 | Schulteis et al. |
| D816,644 | S | 5/2018 | Schulteis et al. |
| D818,460 | S | 5/2018 | Montgomery |
| D819,610 | S | 6/2018 | Zheng |
| D821,367 | S | 6/2018 | Zheng et al. |
| D821,368 | S | 6/2018 | He et al. |
| D822,648 | S | 7/2018 | Gosalia |
| D822,649 | S | 7/2018 | He |
| D823,285 | S | 7/2018 | Montgomery |
| D823,838 | S | 7/2018 | Gosalia et al. |
| D824,372 | S | 7/2018 | Zheng et al. |
| D824,373 | S | 7/2018 | He |
| D824,885 | S | 8/2018 | Gosalia |
| D824,886 | S | 8/2018 | Gosalia |
| D824,887 | S | 8/2018 | Zheng et al. |
| D825,538 | S | 8/2018 | He et al. |
| D826,220 | S | 8/2018 | He |
| D826,909 | S | 8/2018 | He |
| D826,910 | S | 8/2018 | Zhao et al. |
| D826,911 | S | 8/2018 | Wang et al. |
| D828,341 | S | 9/2018 | Chang et al. |
| D829,693 | S | 10/2018 | He et al. |
| D832,241 | S | 10/2018 | He et al. |
| 10,109,918 | B2 | 10/2018 | Thill |
| D833,422 | S | 11/2018 | He |
| 10,164,324 | B1 | 12/2018 | He et al. |
| D837,770 | S | 1/2019 | Schulteis et al. |
| D838,260 | S | 1/2019 | Chang et al. |
| D838,261 | S | 1/2019 | He et al. |
| D838,694 | S | 1/2019 | Chang et al. |
| D838,699 | S | 1/2019 | Chang et al. |
| D838,705 | S | 1/2019 | He et al. |
| D840,986 | S | 2/2019 | Zheng |
| D842,280 | S | 3/2019 | Montgomery |
| D843,985 | S | 3/2019 | Zheng et al. |
| D845,284 | S | 3/2019 | He et al. |
| D846,535 | S | 4/2019 | Gosalia |
| D848,986 | S | 5/2019 | Zheng et al. |
| D848,987 | S | 5/2019 | He et al. |
| D849,724 | S | 5/2019 | He et al. |
| D849,725 | S | 5/2019 | He |
| D850,426 | S | 6/2019 | He et al. |
| D852,785 | S | 7/2019 | Zheng et al. |
| D853,363 | S | 7/2019 | Zheng et al. |
| D856,312 | S | 8/2019 | Iellici |
| D856,983 | S | 8/2019 | Zheng |
| D856,986 | S | 8/2019 | Chang et al. |
| D857,671 | S | 8/2019 | Montgomery et al. |
| D859,371 | S | 9/2019 | Montgomery |
| D859,374 | S | 9/2019 | He et al. |
| D859,375 | S | 9/2019 | Gosalia |
| D859,376 | S | 9/2019 | Gosalia et al. |
| D860,978 | S | 9/2019 | He |
| D860,979 | S | 9/2019 | He |
| D863,267 | S | 10/2019 | Gosalia et al. |
| D863,269 | S | 10/2019 | He |
| D864,174 | S | 10/2019 | Chang et al. |
| D864,175 | S | 10/2019 | Wang et al. |
| D868,046 | S | 11/2019 | Gosalia |
| D868,047 | S | 11/2019 | Zheng |
| D868,757 | S | 12/2019 | He et al. |
| D868,758 | S | 12/2019 | He et al. |
| D868,759 | S | 12/2019 | He et al. |
| D868,760 | S | 12/2019 | Gosalia |
| D869,448 | S | 12/2019 | He et al. |
| D869,451 | S | 12/2019 | He |
| D872,415 | S | 1/2020 | Zheng et al. |
| D872,716 | S | 1/2020 | Wang et al. |
| D872,718 | S | 1/2020 | Bian et al. |
| D874,446 | S | 2/2020 | He et al. |
| 2002/0003499 | A1 | 1/2002 | Kouam et al. |
| 2004/0140941 | A1* | 7/2004 | Joy ..... H01Q 9/16 343/795 |
| 2004/0222936 | A1 | 11/2004 | Hung et al. |
| 2005/0073462 | A1 | 4/2005 | Lin et al. |
| 2005/0190108 | A1 | 9/2005 | Lin et al. |
| 2006/0022888 | A1* | 2/2006 | Cheng ..... H01Q 9/28 343/795 |
| 2006/0208900 | A1 | 9/2006 | Tavassoli Hozouri |
| 2007/0008224 | A1* | 1/2007 | Chung ..... H01Q 9/0421 343/700 MS |
| 2007/0030203 | A1 | 2/2007 | Tsai et al. |
| 2008/0150829 | A1 | 6/2008 | Lin et al. |
| 2009/0002244 | A1 | 1/2009 | Woo |
| 2009/0058739 | A1 | 3/2009 | Konishi |
| 2009/0135072 | A1 | 5/2009 | Ke et al. |
| 2009/0262028 | A1 | 10/2009 | Murnbru et al. |
| 2010/0188297 | A1 | 7/2010 | Chen et al. |
| 2010/0253581 | A1* | 10/2010 | Tsou ..... H01Q 9/42 343/702 |
| 2010/0309067 | A1 | 12/2010 | Tsou et al. |
| 2011/0006950 | A1 | 1/2011 | Park et al. |
| 2012/0038514 | A1 | 2/2012 | Bang |
| 2012/0229348 | A1 | 9/2012 | Chiang |
| 2012/0242546 | A1 | 9/2012 | Hu et al. |
| 2014/0132468 | A1* | 5/2014 | Kim ..... H01Q 5/371 343/793 |
| 2017/0054204 | A1 | 2/2017 | Changalvala et al. |

* cited by examiner

5G BROADBAND ANTENNA

CROSS REFERENCE TO RELATED APPLICATION

The Present Application is a continuation-in-part application of U.S. patent application Ser. No. 16/258,611, filed on Jan. 27, 2019, which claims priority to U.S. Patent Application No. 62/793,871, filed on Jan. 17, 2019, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

This invention relates to 5G broadband antennas.

Description of the Related Art

The prior art discusses various broadband antennas.

Jeng, U.S. Patent Publication Number 20120218164 for a Compact Size Antenna Operating In LTE Frequency Bands, discloses an antenna that meets the 2G/3G/LTE communications systems.

Islam, U.S. Patent Publication Number 20130009836 for a Multi-Band Antenna And Methods For Long Term Evolution Wireless System discloses an antenna with a first structure operable in a lower frequency long term evolution application band and a second structure operable in a second frequency band.

Wong et al, U.S. Patent Publication Number 20130016013 for a Mobile Communication Device And Antenna Device, discloses a mobile communication device operating in LTE and WLAN bands.

Current wireless communication devices such as cellular phone, laptop, tablet computer etc. have an increasing demand for multi-band, high gain, high efficiency and compact size LTE antennas. However, in most cases the design of multi-band LTE antenna is very difficult since it is very hard to get enough bandwidth with good return loss for each frequency band.

General definitions for terms utilized in the pertinent art are set forth below.

BLUETOOTH technology is a standard short range radio link that operates in the unlicensed 2.4 gigahertz band.

Code Division Multiple Access ("CDMA") is a spread spectrum communication system used in second generation and third generation cellular networks, and is described in U.S. Pat. No. 4,901,307.

GSM, Global System for Mobile Communications is a second generation digital cellular network.

The Universal Mobile Telecommunications System ("UMTS") is a wireless standard.

Long Term Evolution ("LTE") is a standard for wireless communication of high-speed data for mobile phones and data terminals and is based on the GSM/EDGE and UMTS/HSPA communication network technologies.

LTE Frequency Bands include 698-798 MHz (Band 12, 13, 14, 17); 791-960 MHz (Band 5, 6, 8, 18, 19, 20); 1710-2170 MHz (Band 1, 2, 3, 4, 9, 10, 23, 25, 33, 34, 35, 36, 37, 39); 1427-1660.5 MH (Band 11, 21, 24); 2300-2700 MHz (Band 7, 38, 40, 41); 3400-3800 MHz (Band 22, 42, 43); 5150-5925 MHz (Band 46, 47).

Antenna impedance and the quality of the impedance match are most commonly characterized by either return loss or Voltage Standing Wave Ratio.

Surface Mount Technology ("SMT") is a process for manufacturing electronic circuits wherein the components are mounted or placed directly onto a surface of a printed circuit board ("PCB").

The APPLE IPHONE® XS LTE bands include 1, 2, 3, 4, 5, 7, 8, 12, 13, 14, 17, 18, 19, 20, 25, 26, 29, 30, 32, 34, 38, 39, 40, 41, 46, 66, 71, and the frequency range covers from 617 MHz up to 5925 MHz.

The SAMSUNG GALAXY® S8 LTE Bands include 1, 2, 3, 4, 5, 7, 8, 12, 13, 17, 18, 19, 20, 25, 26, 28, 29, 30, 32, 40, 41, 46, 66, and the frequency range covers from 699 MHZ up to 2690 MHz.

LG G7 ThinQ LTE bands include 1, 2, 3, 4, 5, 7, 8, 12, 13, 17, 20, 25, 26, 30, 40, 41, 66, 71, and the frequency range covers from 617 MHZ up to 2690 MHz.

For wireless communication devices applications, there are generally three challenging requirements for embedded antenna: good performance, compact size and low cost. What is needed is an antenna that can meet the needs of the 5G broadband mobile device market.

BRIEF SUMMARY OF THE INVENTION

One aspect of the present invention is 5G broadband antenna apparatus. The antenna apparatus comprises a first antenna element and a second antenna element and base. The first antenna element comprises first body with a first long branch, a first middle section having a first slot therein, and a first short branch shorter in length than the long branch. The second antenna element comprises a second body with a second long branch, a second middle section having a second slot therein, and a second short branch shorter in length than the long branch. The antenna apparatus covers a first frequency band of 617-960 MegaHertz, a second frequency band of 1.4-1.6 GigaHertz (GHZ), a third frequency band of 1.71-2.7 GHz, a fourth frequency band of 3.3 to 4.2 GHz, and a fifth frequency band of 4.3-6.0 GHz. The antenna apparatus has a length ranging from 140 millimeters (mm) to 165 mm, and a width ranging from 20 mm to 35 mm.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
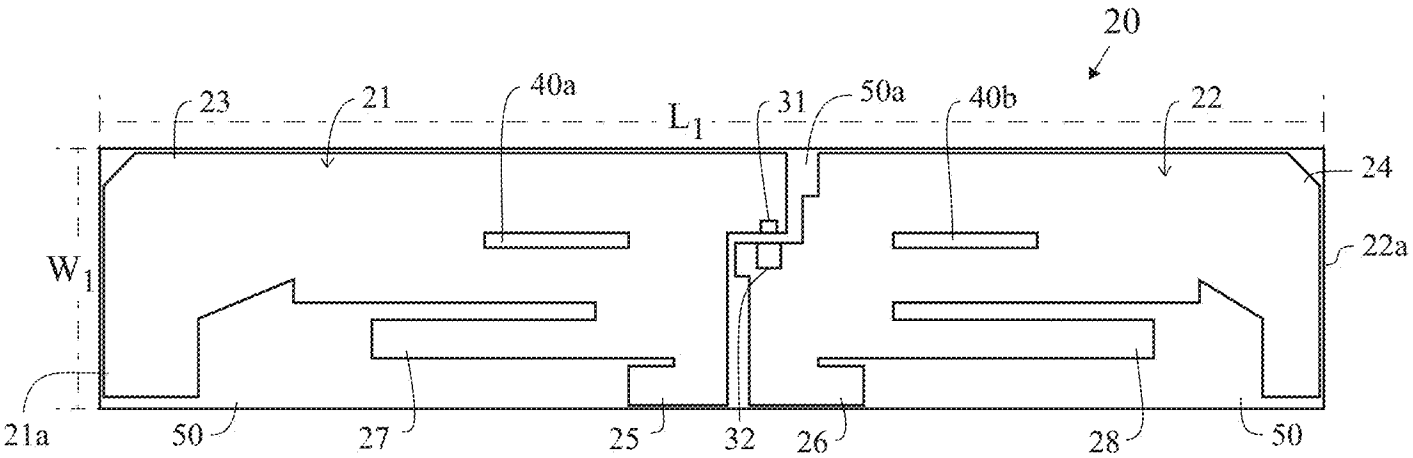
FIG. 1 is top plan view of an antenna assembly.
Figure 2:
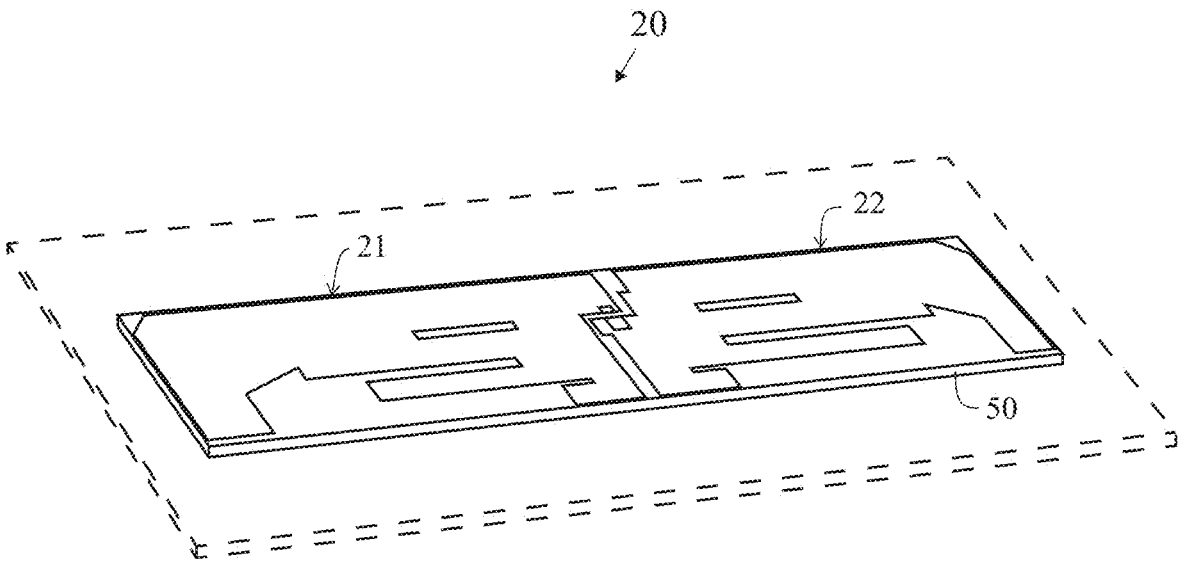
FIG. 2 is a top perspective view of an antenna assembly.

An antenna apparatus 20 is shown in FIGS. 1-2. The antenna apparatus 20 preferably comprises a first antenna element 21 and a second antenna element 22 and base 50. The first antenna element 21 comprises first body with a first main branch 23 having a first slot 40*a* therein, a first mid-branch 27, and a first lower branch 25 shorter in length than the first mid-branch 27. The second antenna element 22 comprises a second body with a second main branch 24 having a second slot 40*b* therein, a second mid-branch 28, and a second lower branch 26 shorter in length than the second mid-branch 28. The first main branch 23 has a first vertical section 21*a* and the second main branch 24 has a second vertical section 22*a*.

The antenna apparatus 20 covers a first frequency band of 617-960 MegaHertz, a second frequency band of 1.4-1.6 GigaHertz (GHZ), a third frequency band of 1.71-2.7 GHz, a fourth frequency band of 3.3 to 4.2 GHz, and a fifth frequency band of 4.3 to 6.0 GHz. The antenna apparatus 20 has a length, $L_1$, preferably ranging from 150 millimeters (mm) to 175 mm, and most preferably 162 mm. The antenna apparatus 20 has a width, $W_1$, preferably ranging from 25 mm to 40 mm, and most preferably 33 mm. The antenna apparatus 20 also has a pad 31 for a cable inner conductor soldering which is approximately 2×1.5 mm and is located on the first antenna element 21, and a pad 32 for a cable outer conductor soldering which is approximately 3×3 mm and is located on the second antenna element 22.

Operating Bands: 617 MHz to 960 MHz; 1.4 GHz to 1.7 GHz; 1.71 GHz to 2.7 GHz; and 3.3 GHz to 4.2 GHz. The Return Loss Spec: −6 dB across band.

A 5G broadband antenna has been designed to meet the market requirement;

The 5G broadband antenna covers a first frequency band of 617-960 MegaHertz, a second frequency band of 1.4-1.6 GigaHertz (GHZ), a third frequency band of 1.71-2.7 GHz, a fourth frequency band of 3.3 to 4.2 GHz, and a fifth frequency band of 4.3 to 6.0 GHz.

A dipole-type 5G broadband cable-fed antenna has been developed to meet market requirement, and its radiation pattern is omni-directional in a plane perpendicular to antenna length;

Return loss: Better than −6 dB across all operation bands (617-960 MHz, 1.4-1.6 GHz, 1.71-2.7 GHz, 3.3-4.2 GHz);

High average efficiency for 617-960 MHz band obtained: 73%.

Average efficiency for 1.4-1.6 GHz band: 68%.

Average efficiency for 1.71-2.7 GHz band: 76%.

Average efficiency for 3.3-4.2 GHz band: 78%.

Average efficiency for 4.3-6.0 GHz band: 70%.

Peak gain for 617-960 MHz band: −0.9-1.9 dBi.

The length of the antenna is 5 mm shorter than an existing wideband LTE antenna N700L series from Airgain Incorporated, and overall performance is better than the N700L series.

Operation bands: 617-960 MegaHertz, a second frequency band of 1.4-1.6 GigaHertz (GHZ), a third frequency band of 1.71-2.7 GHz, a fourth frequency band of 3.3 to 4.2 GHz, and a fifth frequency band of 4.3 to 6.0 GHz.

The total antenna length (162 mm) creates lowest frequency band (base mode $f_0$(617-960 MHz) and its high order modes ($2*f_0$, $3*f_0$, . . . etc.).

The first main branch 23 and the second main branch 24 are two "fat" sections with slots 40*a* and 40*b* used to increase the low band bandwidth to cover 617-960 Mhz.

The first mid-branch 27 and the second mid-branch 28 cover the wide bandwidth for the middle bands ranging 1.4 GHz to 1.6 GHz and 1.71 GHz to 2.7 GHz. The first mid-branch 27 and the second mid-branch 28 combine with the high order modes of the antenna base mode to get wide bandwidth for the middle bands (1.4 GHz to 1.6 GHz and 1.71 GHz to 2.7 GHz).

The first lower branch 25 and the second lower branch 26 cover the wide bandwidth for the high bands ranging 3.3 GHz to 4.2 GHz and 4.3 GHz to 6.0 GHz These two shorter branches 25 and 26 are used to increase the bandwidth of the high bands. These two shorter branches 25 and 26 combine with the high order modes of the antenna base mode to get wide bandwidth for the high bands (3.3 GHz to 4.2 GHz and 4.3 GHz to 6.0 GHz).

This Dipole-type broadband antenna covers the frequency bands of 617-960 MHz, 1.4-1.7 GHz, 1.71-2.7 GHz, 3.3-4.2 GHz and 4.3 GHz to 6.0 GHz.

The total antenna length is determined by electrical small antenna rule and the free space wavelength of the lowest frequency 617 MHz (free space wavelength of 617 MHz: 486.2 mm); This length will create lowest frequency band (base mode f0) and also high order modes (2*f0, 3*f0, . . . etc.).

The most difficult design of this antenna is that it is very hard to get wide bandwidth to cover a low band of 617-960 MHz. To get a wide bandwidth for a low band, two "fat" sections (the first main branch 23 and the second main branch 24) with slots 40*a* and 40*b*, were added on the main antenna body which is able to increase the low band bandwidth significantly.

The antenna apparatus 20 has a return loss spec of −6 dB across the band.

Thill, U.S. patent Ser. No. 10/109,918 for a Multi-Element Antenna For Multiple bands Of Operation And Method Therefor, which is hereby incorporated by reference in its entirety.

The antenna preferably operates on an 802.11 communication protocol. Most preferably, the second antenna element 43 operates on an 802.11n communication protocol. Alternatively, the antenna operates on an 802.11b communication protocol. Alternatively, the antenna operates on an 802.11g communication protocol. Alternatively, the antenna operates on an 802.11a communication protocol. Alternatively, the antenna operates on an 802.11ac communication protocol.

He, U.S. Pat. No. 9,362,621 for a Multi-Band LTE Antenna is hereby incorporated by reference in its entirety.

Abramov et al., U.S. Pat. No. 7,215,296 for a Switch Multi-Beam Antenna Serial is hereby incorporated by reference in its entirety.

Salo et al., U.S. Pat. No. 7,907,971 for an Optimized Directional Antenna System is hereby incorporated by reference in its entirety.

Abramov et al., U.S. Pat. No. 7,570,215 for an Antenna device with a controlled directional pattern and a planar directional antenna is hereby incorporated by reference in its entirety.

Abramov et al., U.S. Pat. No. 7,570,215 for an Antenna device with a controlled directional pattern and a planar directional antenna is hereby incorporated by reference in its entirety.

Abramov et al., U.S. Pat. No. 8,423,084 for a Method for radio communication in a wireless local area network and transceiving device is hereby incorporated by reference in its entirety.

Khitrik et al., U.S. Pat. No. 7,336,959 for an Information transmission method for a wireless local network is hereby incorporated by reference in its entirety.

Khitrik et al., U.S. Pat. No. 7,043,252 for an Information transmission method for a wireless local network is hereby incorporated by reference in its entirety.

Abramov et al., U.S. Pat. No. 8,184,601 for a METHOD FOR RADIO COMMUNICATION INA WIRELESS LOCAL AREA NETWORK WIRELESS LOCAL AREA NETWORK AND TRANSCEIVING DEVICE is hereby incorporated by reference in its entirety.

Abramov et al., U.S. Pat. No. 7,627,300 for a Dynamically optimized smart antenna system is hereby incorporated by reference in its entirety.

Abramov et al., U.S. Pat. No. 6,486,832 for a Direction-agile antenna system for wireless communications is hereby incorporated by reference in its entirety.

Yang, U.S. Pat. No. 8,081,123 for a COMPACT MULTI-LEVEL ANTENNA WITH PHASE SHIFT is hereby incorporated by reference in its entirety.

Nagaev et al., U.S. Pat. No. 7,292,201 for a Directional antenna system with multi-use elements is hereby incorporated by reference in its entirety.

Abramov et al., U.S. Pat. No. 7,696,948 for a Configurable directional antenna is hereby incorporated by reference in its entirety.

Abramov et al., U.S. Pat. No. 7,965,242 for a Dual-band antenna is hereby incorporated by reference in its entirety.

Abramov et al., U.S. Pat. No. 7,729,662 for a Radio communication method in a wireless local network is hereby incorporated by reference in its entirety.

Abramov et al., U.S. Pat. No. 8,248,970 for an OPTIMIZED DIRECTIONAL MIMO ANTENNA SYSTEM is hereby incorporated by reference in its entirety.

Visuri et al., U.S. Pat. No. 8,175,036 for a MULTIMEDIA WIRELESS DISTRIBUTION SYSTEMS AND METHODS is hereby incorporated by reference in its entirety.

Yang, U.S. Patent Publication Number 20110235755 for an MIMO Radio System With Antenna Signal Combiner is hereby incorporated by reference in its entirety.

Yang et al., U.S. Pat. No. 9,013,355 for an L SHAPED FEED AS PART OF A MATCHING NETWORK FOR A MICROSTRIP ANTENNA is hereby incorporated by reference in its entirety.

Figure 3:
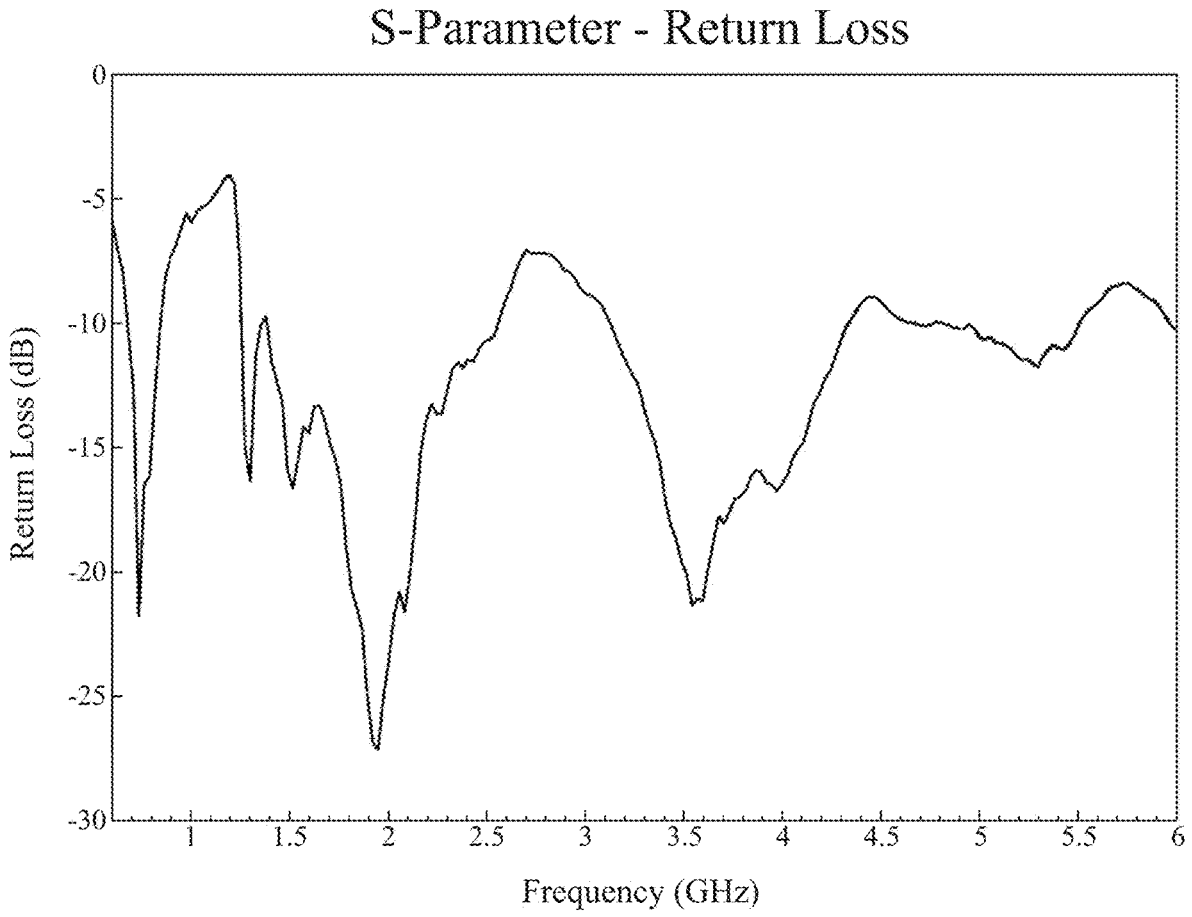
FIG. 3 is a graph of the S-Parameter return loss for a 5G broadband antenna.
Figure 4:
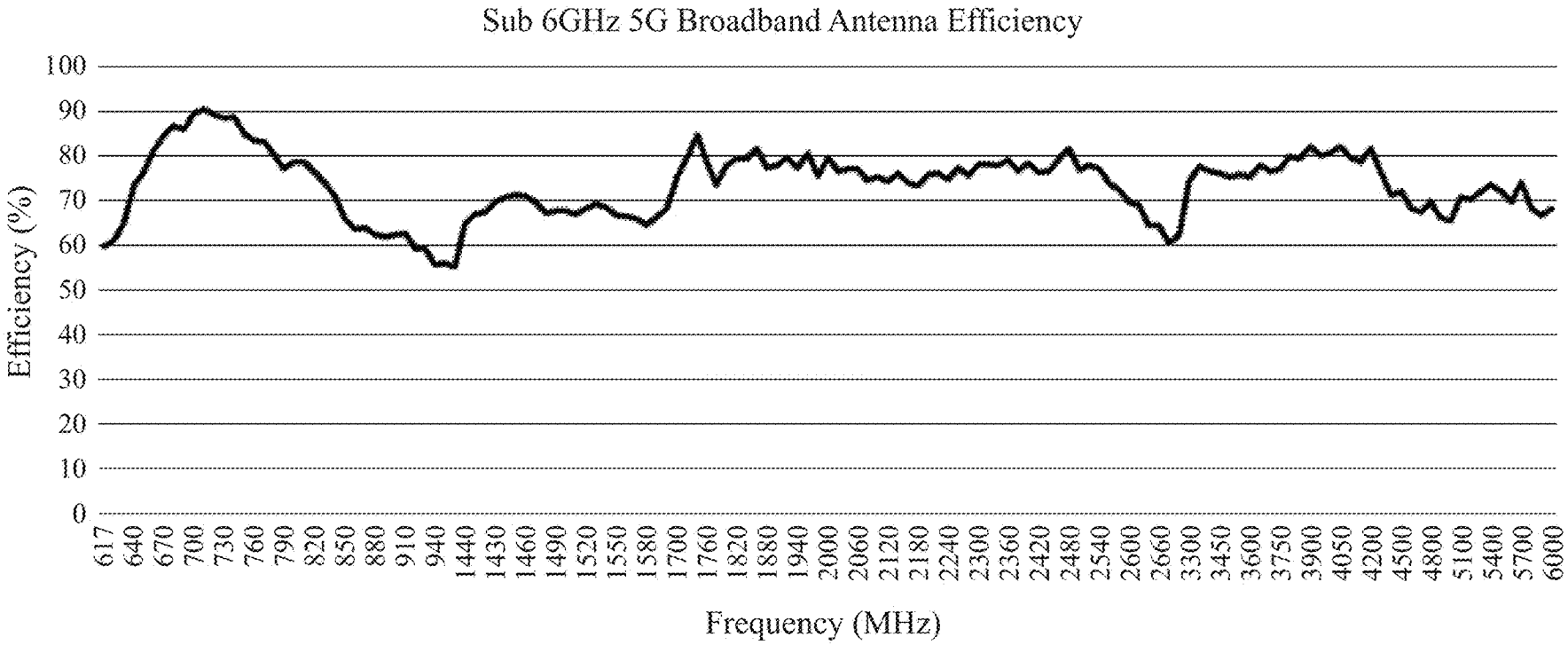
FIG. 4 is a graph of the overall efficiency of a 5G broadband antenna from 617 MHz to 6. GHz.
Figure 5:
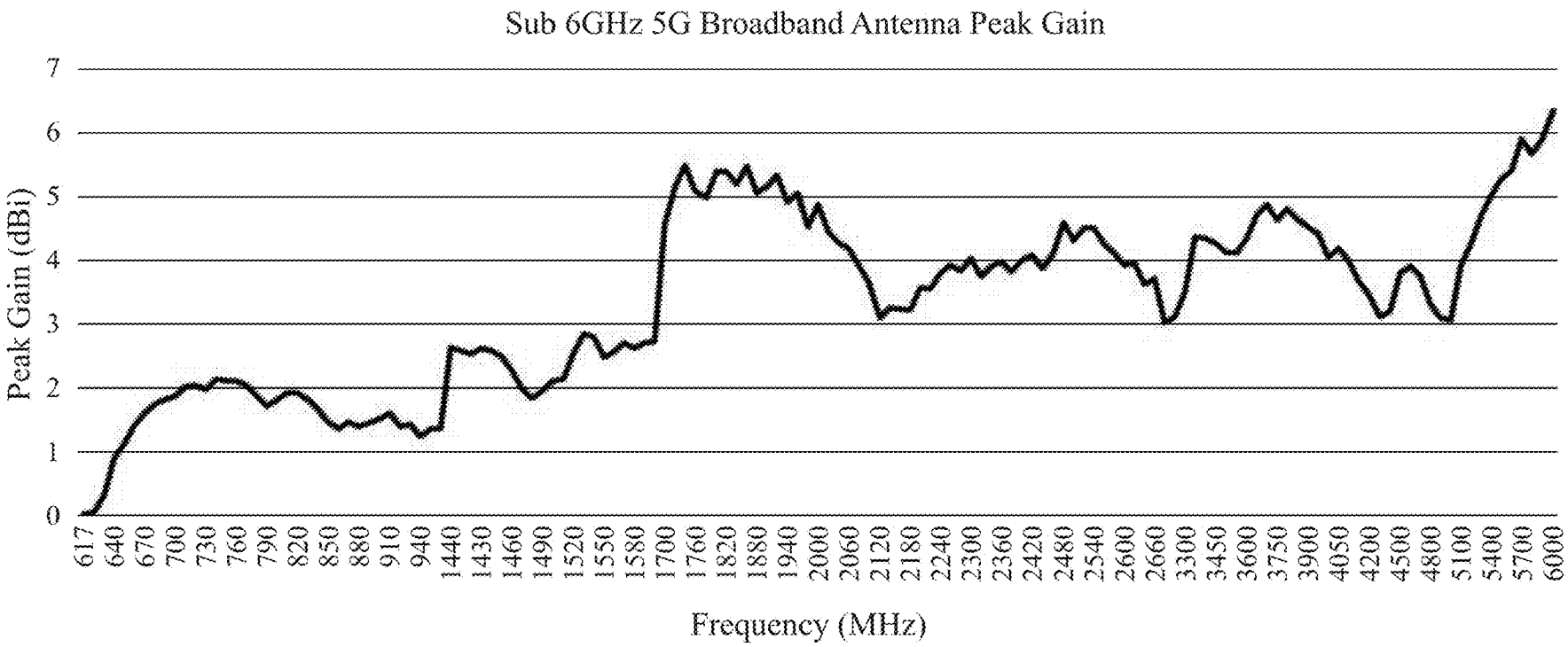
FIG. 5 is a graph of the antenna peak gain of a 5G broadband antenna from 617 MHz to 6. GHz.

Tables One, Two and Three list the S-Parameter return loss for the 5-G antenna at frequencies between 617 MHz and 6.0 GHz. FIG. 3 is a graph of the S-Parameter return loss for a 5G broadband antenna. FIG. 4 is a graph of the overall efficiency of a 5G broadband antenna from 617 MHz to 6. GHz. FIG. 5 is a graph of the antenna peak gain of a 5G broadband antenna from 617 MHz to 6. GHz.

Figure 6:
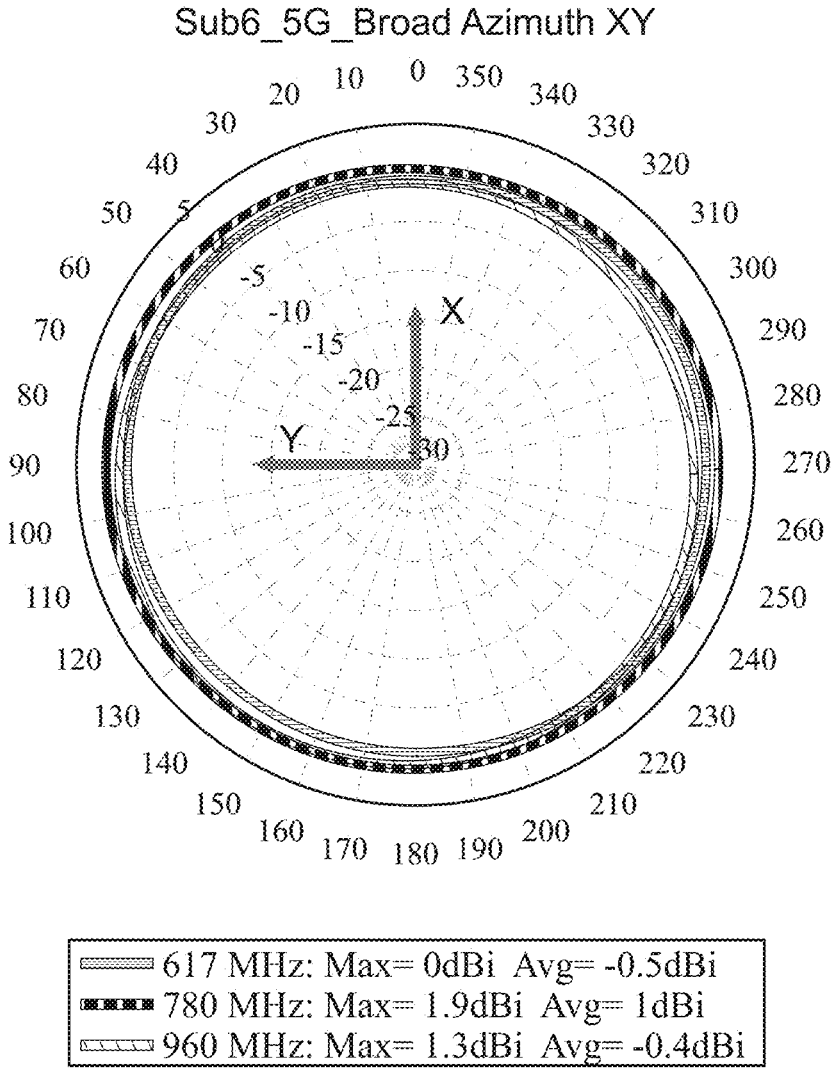
FIG. 6 illustrates azimuth.
Figure 7:
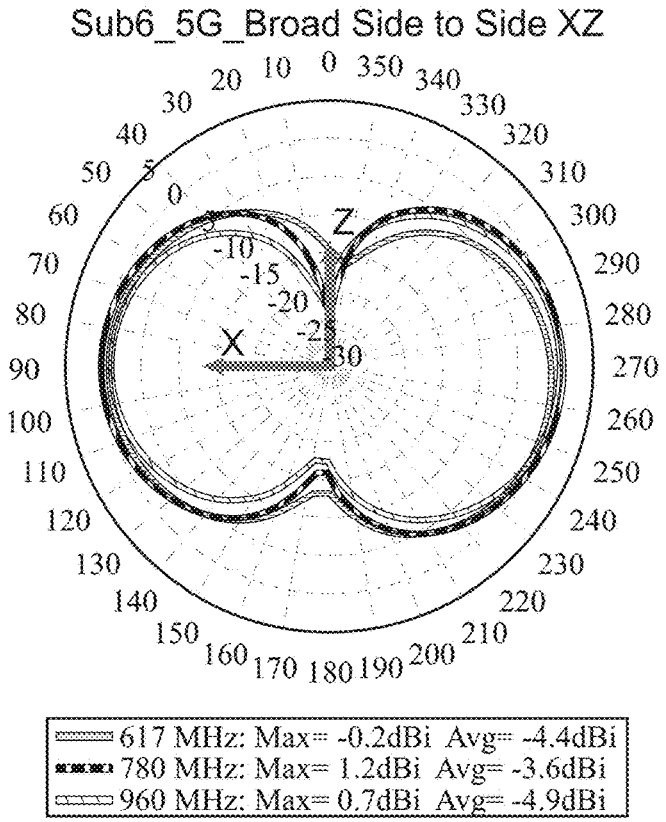
FIG. 7 illustrates side to side elevation.
Figure 8:
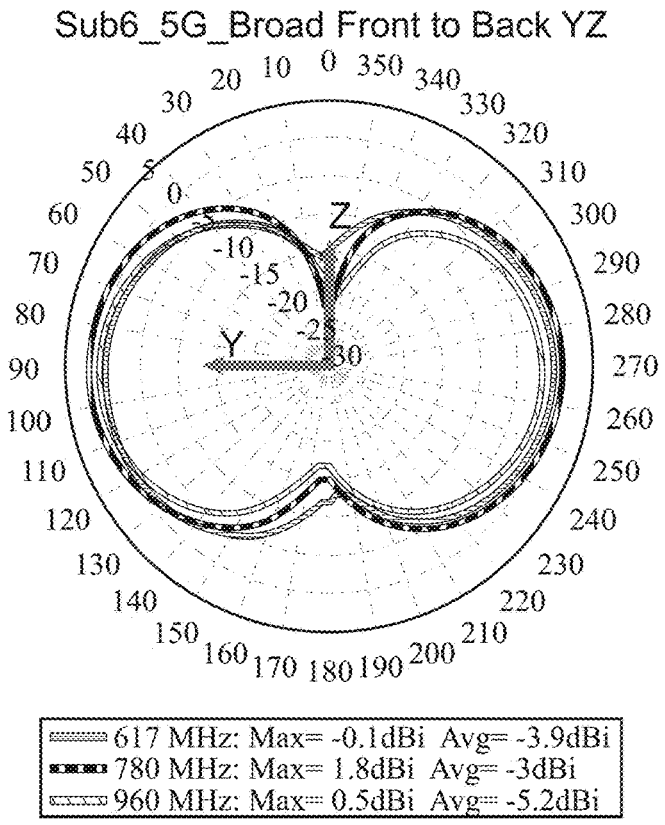
FIG. 8 illustrates front to back elevation.
Figure 9:
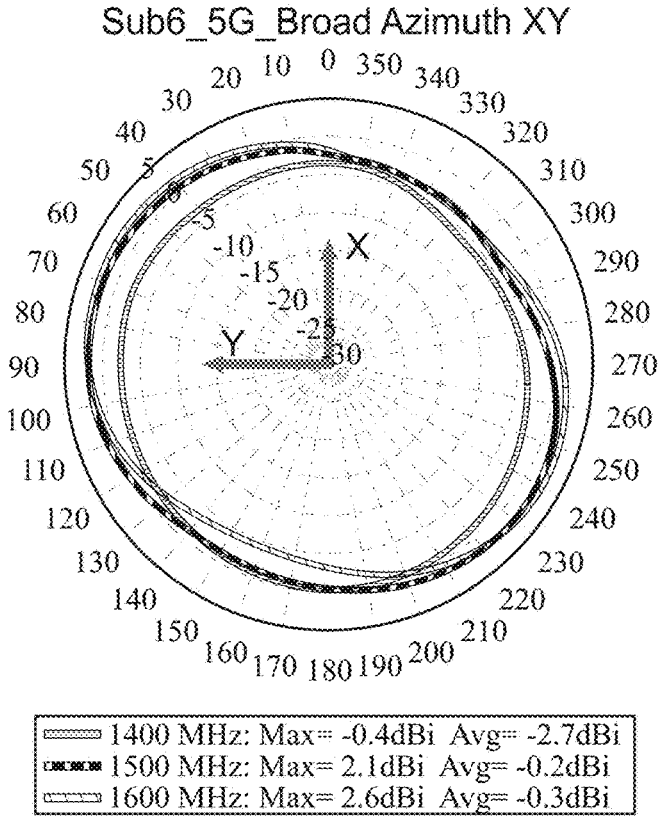
FIG. 9 illustrates azimuth.
Figure 10:
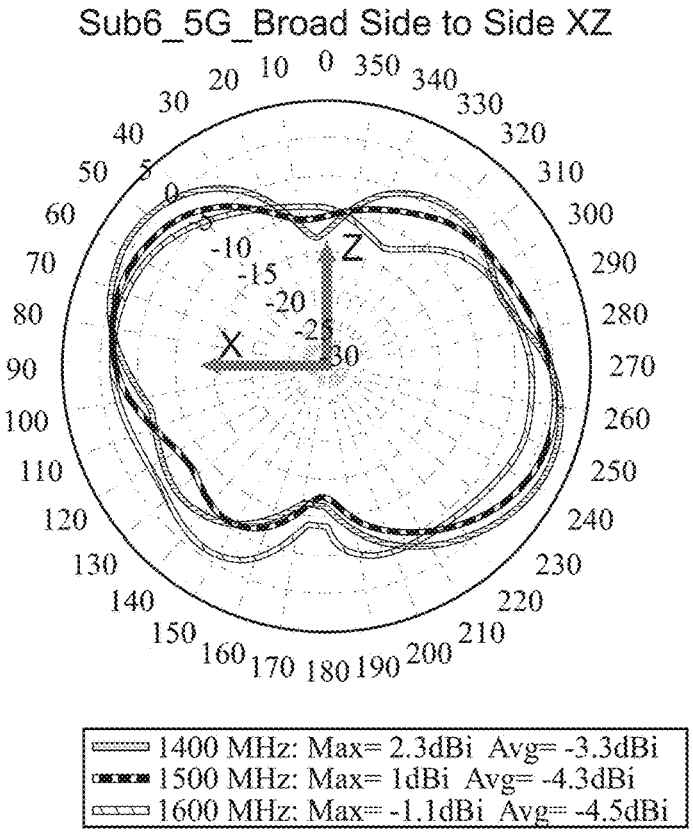
FIG. 10 illustrates side to side elevation.
Figure 11:
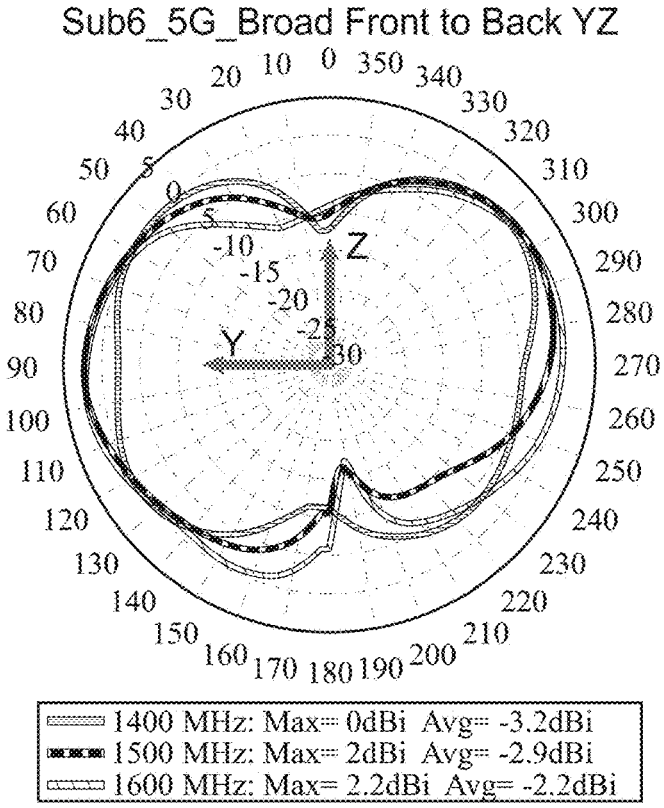
FIG. 11 illustrates front to back elevation.
Figure 12:
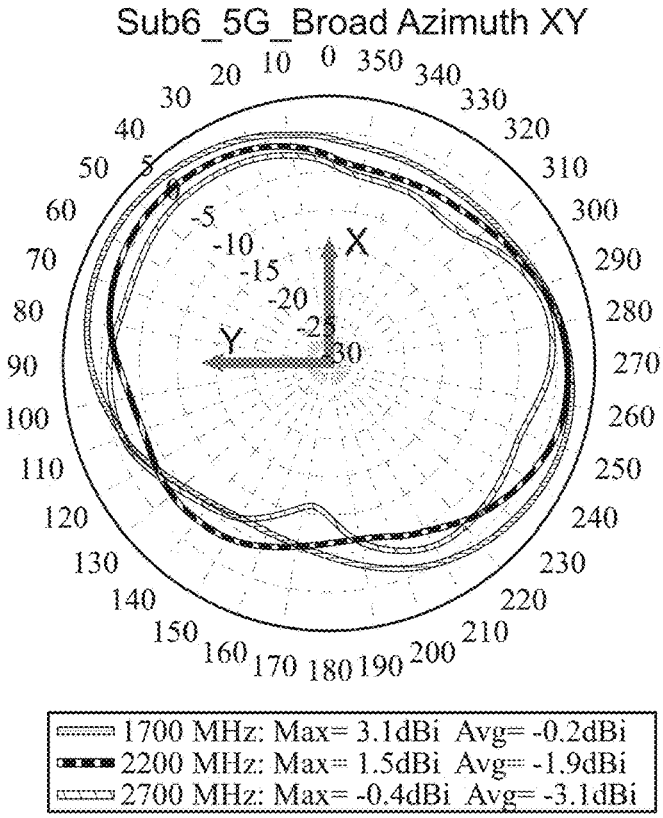
FIG. 12 illustrates azimuth.
Figure 13:
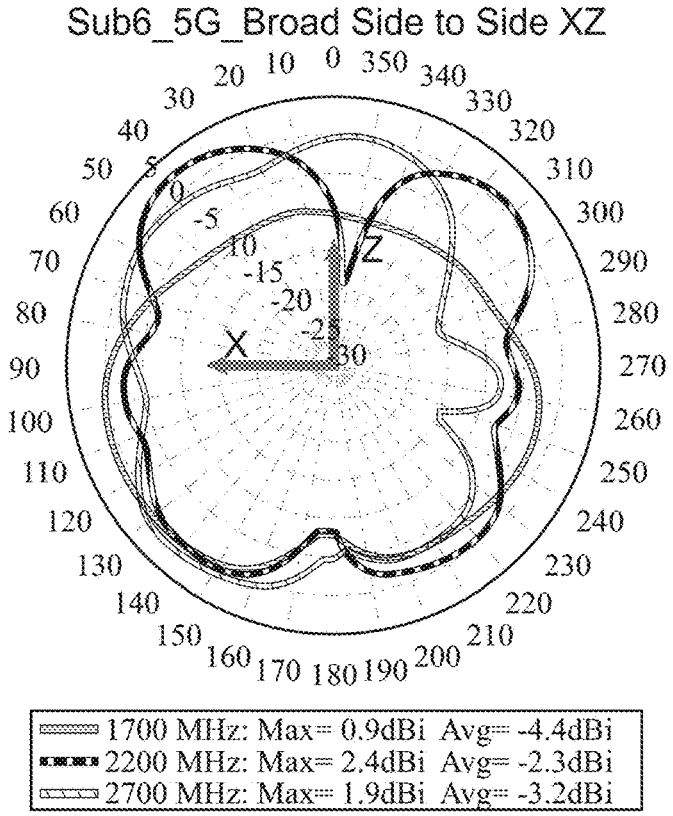
FIG. 13 illustrates side to side elevation.
Figure 14:
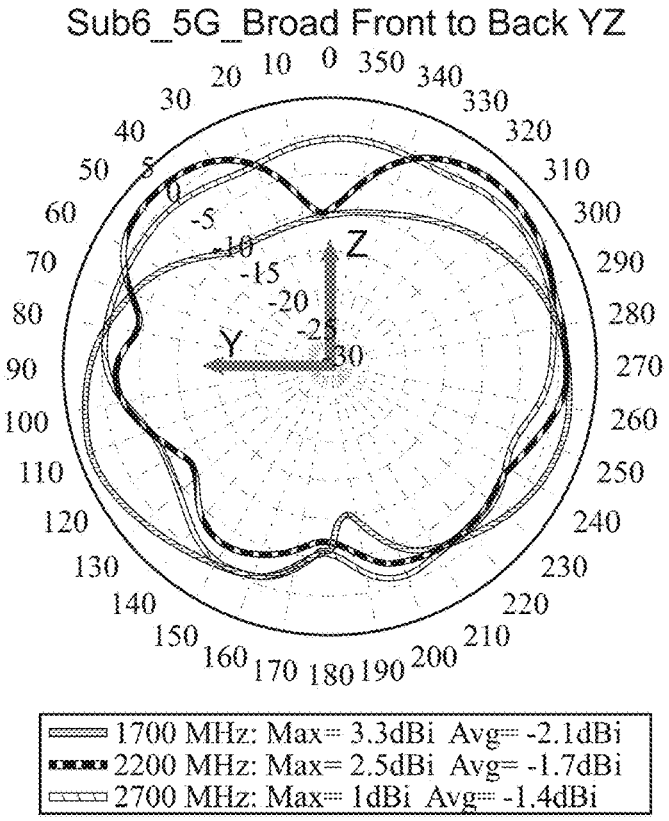
FIG. 14 illustrates front to back elevation.
Figure 15:
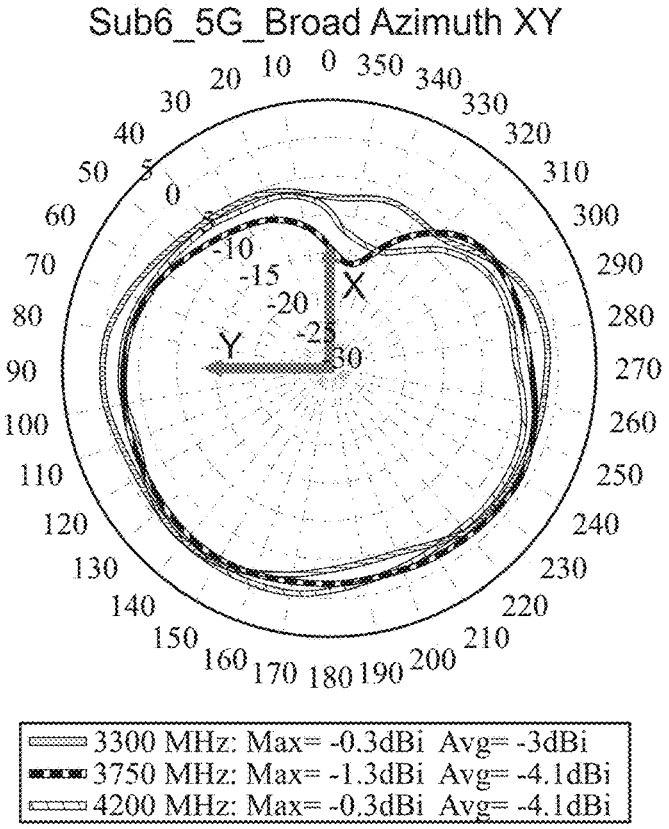
FIG. 15 illustrates azimuth.
Figure 16:
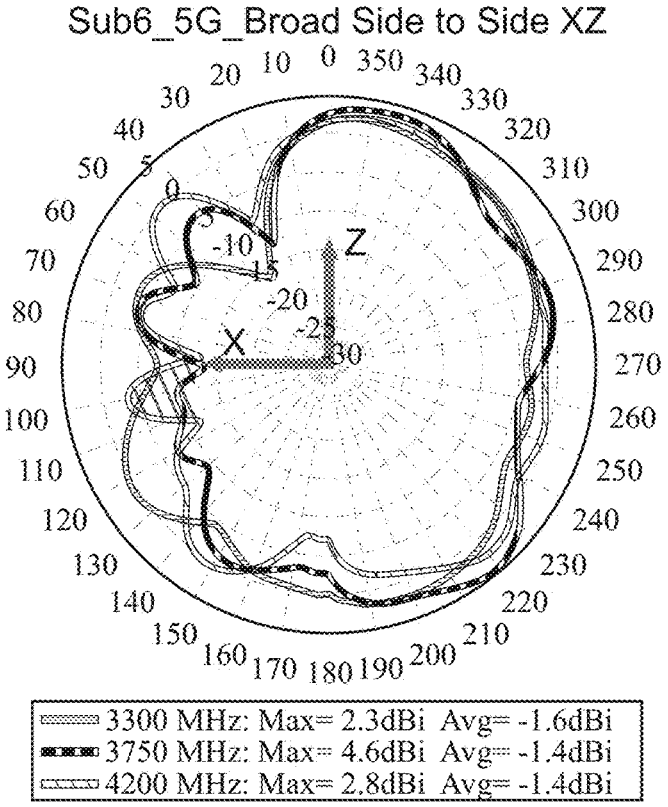
FIG. 16 illustrates side to side elevation.
Figure 17:
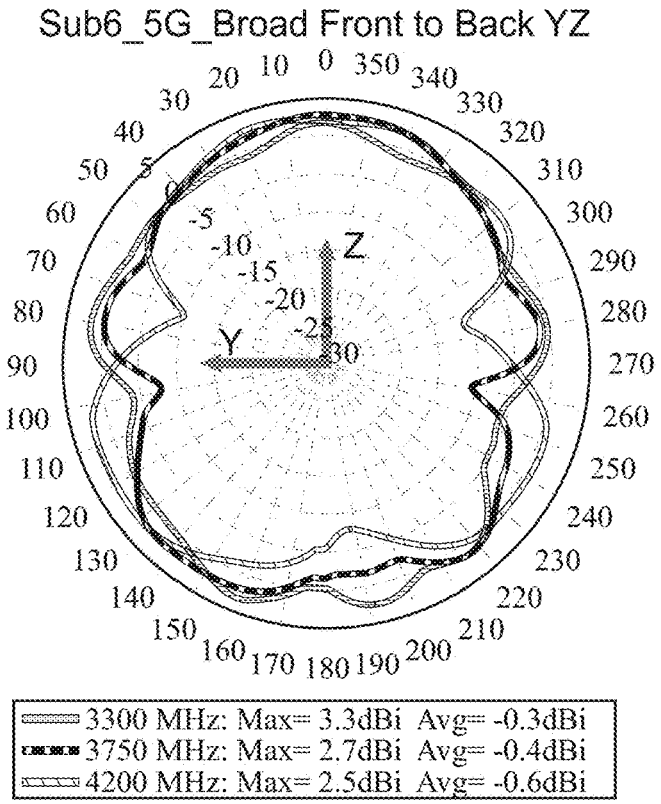
FIG. 17 illustrates front to back elevation.
Figure 18:
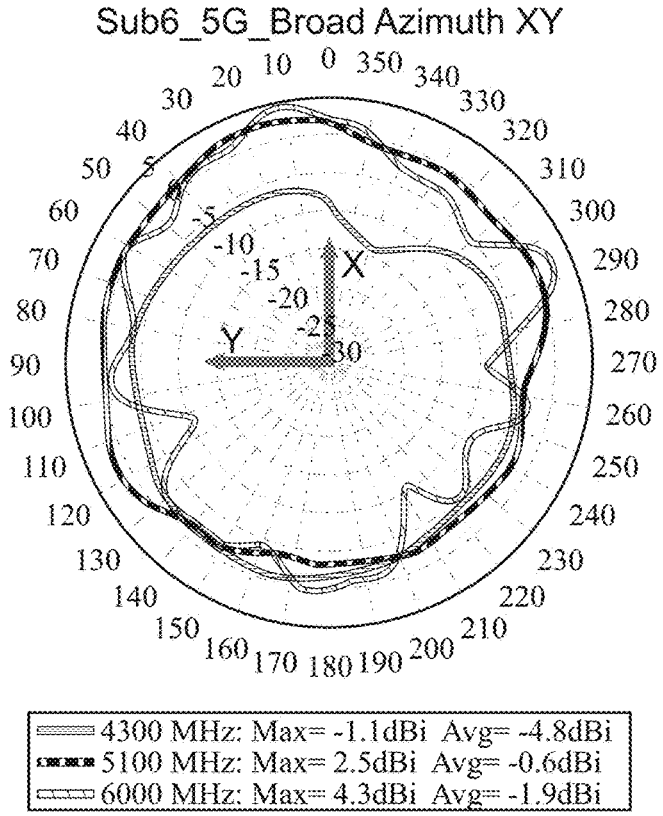
FIG. 18 illustrates azimuth.
Figure 19:
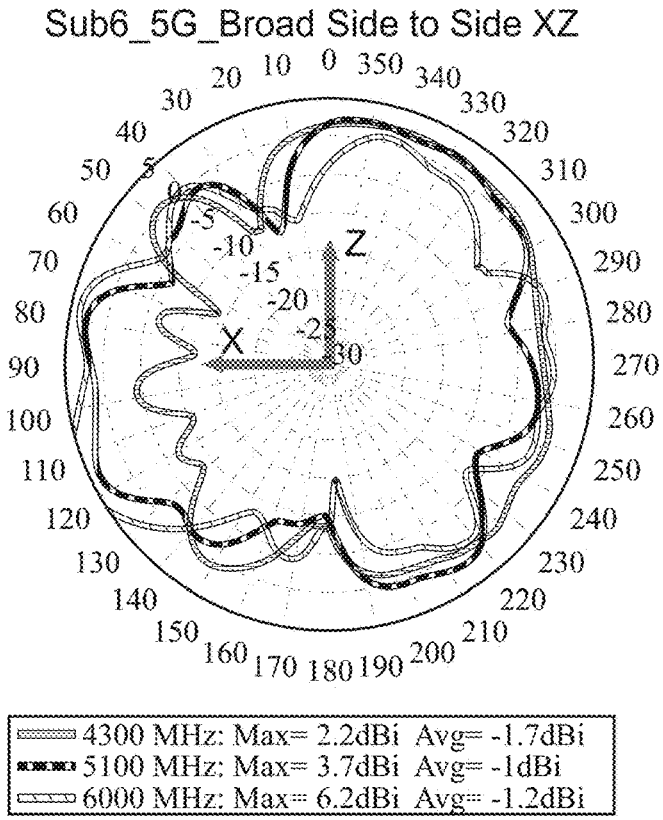
FIG. 19 illustrates side to side elevation.
Figure 20:
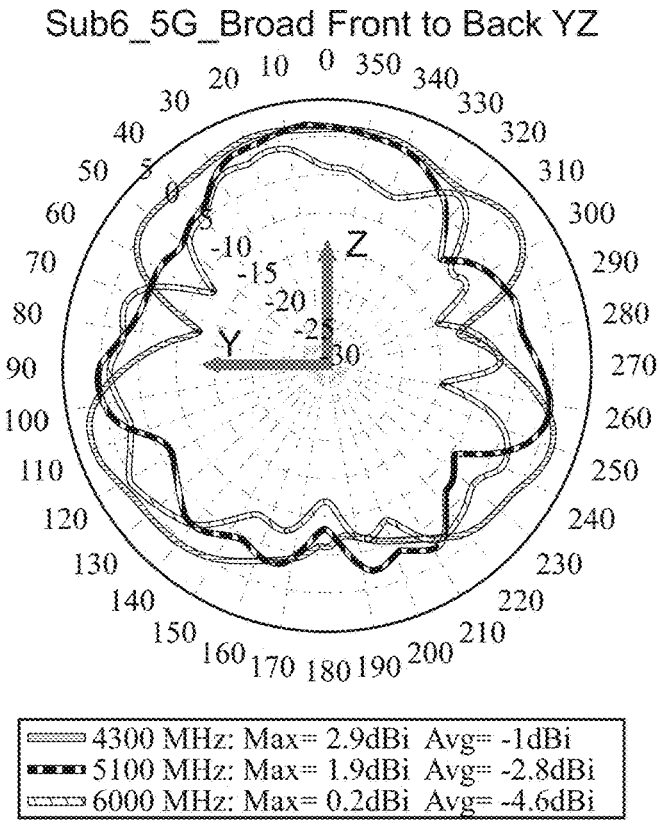
FIG. 20 illustrates front to back elevation.

FIGS. 6-8 illustrate an antenna radiation pattern for a first frequency band of 617-960 MegaHertz. FIGS. 9-11 illustrate an antenna radiation pattern for a second frequency band of 1.4-1.6 GigaHertz (GHZ). FIGS. 12-14 illustrate an antenna radiation pattern for a third frequency band of 1.71-2.7 GHz. FIGS. 15-17 illustrate an antenna radiation pattern for a fourth frequency band of 3.3 to 4.2 GHz. FIGS. 18-20 illustrate an antenna radiation pattern for a fifth frequency band of 4.3 to 6.0 GHz.

TABLE ONE

| Antenna | 617 MHz | 960 MHz | 1.4 GHz | 1.6 GHz |
|---|---|---|---|---|
| Return Loss | −6.1 dB | −6.0 dB | −11.5 dB | −14.4 dB |

TABLE TWO

| Antenna | 1.71 GHz | 2.7 GHz | 3.3 GHz | 4.2 GHz |
|---|---|---|---|---|
| Return Loss | −14.8 dB | −7.1 dB | −14.2 dB | −12.8 dB |

TABLE THREE

| Antenna | 4.3 GHz | 6.0 Hz |
|---|---|---|
| Return Loss | −10.7 dB | −10.2 dB |

TABLE FOUR

| Frequency (MHz) | Antenna Efficiency (%) | Peak Gain |
|---|---|---|
| 617 | 60 | 0.0 |
| 620 | 61 | 0.1 |
| 630 | 65 | 0.3 |
| 640 | 74 | 0.9 |
| 650 | 76 | 1.1 |
| 660 | 81 | 1.4 |
| 670 | 84 | 1.6 |
| 680 | 87 | 1.7 |
| 690 | 86 | 1.8 |
| 700 | 89 | 1.9 |
| 710 | 91 | 2.0 |
| 720 | 89 | 2.0 |
| 730 | 89 | 2.0 |
| 740 | 89 | 2.1 |
| 750 | 85 | 2.1 |
| 760 | 84 | 2.1 |
| 770 | 83 | 2.0 |
| 780 | 80 | 1.9 |
| 790 | 77 | 1.7 |

TABLE FIVE

| Frequency (MHz) | Antenna Efficiency (%) | Peak Gain |
|---|---|---|
| 800 | 79 | 1.8 |
| 810 | 79 | 1.9 |
| 820 | 76 | 1.9 |
| 830 | 74 | 1.8 |
| 840 | 71 | 1.7 |
| 850 | 66 | 1.5 |
| 860 | 64 | 1.4 |
| 870 | 64 | 1.5 |
| 880 | 63 | 1.4 |
| 890 | 62 | 1.4 |
| 900 | 62 | 1.5 |
| 910 | 63 | 1.6 |
| 920 | 59 | 1.4 |
| 930 | 59 | 1.4 |
| 940 | 56 | 1.2 |
| 950 | 56 | 1.4 |
| 960 | 55 | 1.4 |

TABLE SIX

| Frequency (MHz) | Antenna Efficiency (%) | Peak Gain dBi |
|---|---|---|
| 1400 | 65 | 2.6 |
| 1410 | 67 | 2.6 |
| 1420 | 68 | 2.5 |
| 1430 | 70 | 2.6 |
| 1440 | 71 | 2.6 |
| 1450 | 71 | 2.5 |
| 1460 | 71 | 2.3 |
| 1470 | 70 | 2.0 |
| 1480 | 67 | 1.8 |
| 1490 | 68 | 2.0 |
| 1500 | 68 | 2.1 |
| 1510 | 67 | 2.1 |
| 1520 | 68 | 2.5 |
| 1530 | 69 | 2.8 |
| 1540 | 69 | 2.8 |
| 1550 | 67 | 2.5 |
| 1560 | 67 | 2.6 |
| 1570 | 66 | 2.7 |
| 1580 | 65 | 2.6 |
| 1590 | 66 | 2.7 |
| 1600 | 68 | 2.7 |

Tables Four through Eleven list the Efficiency and antenna peak gain at frequencies ranging from 617 MHz to 6000 MHz. The average antenna efficiency for: 617 MHz-960 MHz is 73%; 1.4 GHz-1.6 GHz is 68%; 1.71 GHz-2.7 GHz is 76%; 3.3 GHz-4.2 GHz is 78%; and 4.3 GHz-6.0 GHz is 70%.

TABLE SEVEN

| Frequency (MHz) | Efficiency % | Peak Gain dBi |
|---|---|---|
| 1700 | 75 | 4.6 |
| 1720 | 80 | 5.1 |
| 1740 | 85 | 5.5 |
| 1760 | 78 | 5.1 |
| 1780 | 73 | 5.0 |
| 1800 | 78 | 5.4 |
| 1820 | 79 | 5.4 |
| 1840 | 79 | 5.2 |
| 1860 | 82 | 5.5 |
| 1880 | 77 | 5.0 |
| 1900 | 78 | 5.1 |
| 1920 | 80 | 5.3 |
| 1940 | 77 | 4.9 |
| 1960 | 81 | 5.1 |
| 1980 | 76 | 4.5 |

TABLE EIGHT

| Frequency (MHz) | Efficiency % | Peak Gain (dBi) |
|---|---|---|
| 2000 | 80 | 4.9 |
| 2020 | 77 | 4.4 |
| 2040 | 77 | 4.3 |
| 2060 | 77 | 4.2 |
| 2080 | 75 | 3.9 |
| 2100 | 75 | 3.6 |
| 2120 | 74 | 3.1 |
| 2140 | 76 | 3.2 |
| 2160 | 74 | 3.2 |
| 2180 | 73 | 3.2 |
| 2200 | 76 | 3.6 |
| 2220 | 76 | 3.5 |
| 2240 | 75 | 3.8 |
| 2260 | 77 | 3.9 |
| 2280 | 76 | 3.8 |
| 2300 | 78 | 4.0 |
| 2320 | 78 | 3.7 |
| 2340 | 78 | 3.9 |
| 2360 | 79 | 4.0 |
| 2380 | 77 | 3.8 |

TABLE NINE

| Frequency (MHz) | Efficiency % | Peak Gain (dBi) |
|---|---|---|
| 2400 | 78 | 4.0 |
| 2420 | 76 | 4.1 |
| 2440 | 77 | 3.9 |
| 2460 | 79 | 4.1 |
| 2480 | 82 | 4.6 |
| 2500 | 77 | 4.3 |
| 2520 | 78 | 4.5 |
| 2540 | 77 | 4.5 |
| 2560 | 74 | 4.2 |
| 2580 | 72 | 4.1 |
| 2600 | 70 | 3.9 |
| 2620 | 69 | 4.0 |
| 2640 | 64 | 3.6 |
| 2660 | 65 | 3.7 |
| 2680 | 61 | 3.0 |
| 2700 | 63 | 3.1 |

TABLE TEN

| Frequency (MHz) | Efficiency % | Peak Gain (dBi) |
|---|---|---|
| 3300 | 75 | 3.5 |
| 3350 | 78 | 4.4 |
| 3400 | 77 | 4.3 |
| 3450 | 76 | 4.2 |
| 3500 | 75 | 4.1 |
| 3550 | 76 | 4.1 |
| 3600 | 75 | 4.1 |
| 3650 | 78 | 4.7 |
| 3700 | 77 | 4.9 |
| 3750 | 77 | 4.6 |
| 3800 | 80 | 4.8 |
| 3850 | 79 | 4.6 |
| 3900 | 82 | 4.5 |
| 3950 | 80 | 4.4 |
| 4000 | 81 | 4.0 |
| 4050 | 82 | 4.2 |
| 4100 | 80 | 4.0 |
| 4150 | 79 | 3.7 |
| 4200 | 82 | 3.5 |

TABLE ELEVEN

| Frequency (MHz) | Efficiency % | Peak Gain (dBi) |
|---|---|---|
| 4300 | 76 | 3.1 |
| 4400 | 71 | 3.2 |
| 4500 | 72 | 3.8 |
| 4600 | 68 | 3.9 |
| 4700 | 68 | 3.7 |
| 4800 | 70 | 3.3 |
| 4900 | 66 | 3.1 |
| 5000 | 66 | 3.1 |
| 5100 | 71 | 3.9 |
| 5200 | 70 | 4.3 |
| 5300 | 72 | 4.7 |
| 5400 | 74 | 5.0 |
| 5500 | 72 | 5.3 |
| 5600 | 70 | 5.4 |
| 5700 | 74 | 5.9 |
| 5800 | 68 | 5.7 |
| 5900 | 67 | 5.9 |
| 6000 | 68 | 6.3 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention:

1. A 5G broadband antenna apparatus, the antenna apparatus comprising:

a first antenna element comprising a first body with a first main branch having a first internal slot therein, a first mid-branch, and a first lower branch shorter in length than the first mid-branch and the first mid-branch between the first main branch and the first lower branch;

a second antenna element comprising a second body with a second main branch having a second internal slot therein, a second mid-branch, and a second lower branch shorter in length than the second mid-branch and the second mid-branch between the second main branch and the second lower branch;

wherein the antenna apparatus covers a first frequency band of 617-960 MegaHertz, a second frequency band of 1.4-1.6 GigaHertz (GHz), a third frequency band of 1.71-2.7 GHz, a fourth frequency band of 3.3 to 4.2 GHz, and a fifth frequency band of 4.3 to 6.0 GHz;

wherein the first lower branch and the second lower branch cover the high band bandwidth ranging 3.3 to 4.2 GHz and the high band bandwidth ranging 4.3 to 6.0 GHz.

2. The antenna apparatus according to claim 1 further comprising a base, wherein the first antenna element and the second antenna element are disposed on a surface of the base.

3. The antenna apparatus according to claim 2 further comprising a feed coaxial cable with an inner conductor connected to a feed point on the first antenna element and with an outer conductor connected to a grounding point on the second antenna element.

4. The antenna apparatus according to claim 1 wherein the antenna apparatus has a length ranging from 150 millimeters (mm) to 175 mm, and a width ranging from 25 mm to 40 mm.

5. The antenna apparatus according to claim 2 wherein the base is a PCB.

6. A 5G broadband antenna apparatus, the antenna apparatus comprising:

a base;

a first antenna element comprising a first body with a first main branch having a first internal slot therein, a first mid-branch, and a first lower branch shorter in length than the first mid-branch;

a second antenna element comprising a second body with a second main branch having a second internal slot therein, a second mid-branch, and a second lower branch shorter in length than the second mid-branch;

wherein the antenna apparatus covers a first frequency band of 617-960 MegaHertz, a second frequency band of 1.4-1.6 GigaHertz (GHZ), a third frequency band of 1.71-2.7 GHz, a fourth frequency band of 3.3 to 4.2 GHz, and a fifth frequency band of 4.3 to 6.0 GHz;

wherein the first lower branch and the second lower branch cover the high band bandwidth ranging 3.3 to 4.2 GHz and the high band bandwidth ranging 4.3 to 6.0 GHz.

7. The antenna apparatus according to claim 6 wherein the first main branch and the second main branch cover the low band bandwidth ranging 617 MHz to 960 MHz.

8. The antenna apparatus according to claim 6 wherein the antenna apparatus has a length ranging from 150 millimeters (mm) to 175 mm, and a width ranging from 25 mm to 40 mm.

9. The antenna apparatus according to claim 6 further comprising a feed coaxial cable with an inner conductor connected to a feed point on the first antenna element and with an outer conductor connected to a grounding point on the second antenna element.

10. The antenna apparatus according to claim 6 wherein the first main branch has a first vertical section and the second main branch has a second vertical section.

11. The antenna apparatus according to claim 6 wherein the first mid-branch and the second mid-branch cover the wide bandwidth for the middle bands ranging 1.4 GHz to 1.6 GHz and 1.71 GHz to 2.7 GHz.

* * * * *